United States Patent [19]

Smith

[11] 4,185,352

[45] Jan. 29, 1980

[54] SCRAPED-SURFACE APPARATUS

[75] Inventor: Robert L. Smith, Louisville, Ky.

[73] Assignee: Chemetron Corporation, Chicago, Ill.

[21] Appl. No.: 876,596

[22] Filed: Feb. 10, 1978

[51] Int. Cl.[2] ..... F28G 3/12

[52] U.S. Cl. ..... 15/246.5; 62/354; 15/104.04; 165/95

[58] Field of Search ..... 15/104.04, 246.5, 246; 165/95; 62/284, 354; 366/311

[56] References Cited

U.S. PATENT DOCUMENTS

| | | | |
|---|---|---|---|
| 3,145,017 | 8/1964 | Thomas | 366/311 X |
| 3,848,289 | 11/1974 | Bachmann | 15/246.5 |
| 4,073,339 | 2/1978 | D'Orsay | 62/354 X |

*Primary Examiner*—Edward L. Roberts

*Attorney, Agent, or Firm*—Vincent G. Gioia; John K. Williamson

[57] ABSTRACT

Scraped-surface heat exchangers and similar apparatus employing scraper blades hinged to a shaft so as to scrape a fluid being processed from an elongated cylindrical wall are improved so as to obviate any need either for separate bearings at opposite ends of the shaft or for special skids to be used in disassembly and reassembly and so as to allow the blades to be biased against the wall without separate springs. Each blade bears on the wall not only at its leading or scraping edge but also at a trailing or bearing surface, so as to center the shaft and facilitate its rotation, so as to hold the edge in uniform relation to the wall, and so as to bias the edge of the blade against the wall.

7 Claims, 4 Drawing Figures

SCRAPED-SURFACE APPARATUS

BACKGROUND OF THE INVENTION

Scraped-surface heat exchangers and similar apparatus employing hinged blades to scrape a fluid being processed from an elongated cylindrical wall or exemplified in U.S. Pat. Nos. 2,281,944, 2,235,002, 3,385,354, 3,568,463, and 3,848,289; cf. U.S. Pat. No. 2,776,765, which shows fixed blades. Various uses of such apparatus are described in A. E. Bailey, INDUSTRIAL OIL AND FAT PRODUCTS (3rd edition, Interscience Publishers, Division of John Wiley & Sons) at pages 1066 et seq. and in Bulletin V300 entitled "VOTATOR® Scraped Surface Heat Exchangers" and published by Chemetron Corporation, P.O. Box 35600, Louisville, Kentucky 40232.

Such apparatus generally comprises a chamber having an elongated cylindrical wall, within which a shaft is rotatable concentrically, and scraper blades are hinged to the shaft, as by radial pins. In some apparatus, the blades are biased by separate springs into edge contact with the wall.

As manufactured and sold by Chemetron Corporation, such apparatus often are several feet or more long with a ratio between eight and twenty-four of overall length to inner diameter of the wall. In prior apparatus, particularly horizontal apparatus as commonly used as scraped-surface heat exchangers, the ratio has been limited so as to avoid excessive flexure and consequent misalignment of the shaft. Furthermore, it has been conventional to employ roller bearings at opposite ends of the shaft. Intermediate bearings within the chamber have been tried to some extent to minimize the flexure of the shaft.

Serious problems can occur in disassembly and reassembly, as for purposes of sanitation, wherein tube scoring and blade damage can easily result as the shaft and blade assembly is moved through one end of the tube. Although elongated spacers known as "shaft skids" are available to separate the shaft and the tube so as to prevent destructive contact between the pins hinging the blades and the tube, such "skids" are not always employed and tube scoring and blade damage thus have not been effectively eliminated before this invention.

SUMMARY OF THE INVENTION

This invention not only eliminates any need for conventional bearings at opposite ends of the shaft but also effectively addresses such problems in disassembly and reassembly and also enables the blades advantageously to be biased against the wall without separate springs. Good sanitation is enhanced by this invention.

As in conventional apparatus, a tube has an elongated cylindrical wall, and a shaft is concentric with the wall and rotatable about their common central axis. Each blade is hinged to the shaft, as by conventional pins, for pivotal movement about an axis parallel with such axis and scrapes the fluid from the wall as the shaft rotates.

According to this invention, each blade contacts and bears on the wall not only at its leading or scraping edge but also at a trailing or bearing surface, which is formed on the blade. By suitable arrangement of plural blades, the respective bearing surfaces can serve effectively as the only rotational bearings required to center the shaft and facilitate its rotation. Furthermore, the edge of the blade can be biased against the wall without separate springs, by frictional engagement between these surfaces and the wall.

In disassembly and reassembly, each blade serves as a skid, so as to prevent destructive contact between the pins hinging the blades and the wall as the shaft and the blades are drawn through one end of the tube. Frictional contact between the blades and the tube is characteristic of normal operation of such apparatus and thus causes no difficulties in disassembly and reassembly.

Commercially available pre-polished stainless steel tubes may be economically and effectively used without further boring or honing operations. Good sanitation is enhanced as separate springs are not employed and long lightweight shafts may be employed.

The foregoing and other objects, features, and advantages of this invention will be evident from the following detailed description of a presently preferred embodiment of this invention with particular reference to the accompanying drawings.

DETAILED DESCRIPTION OF PREFERRED EMBODIMENT

Figure 1:
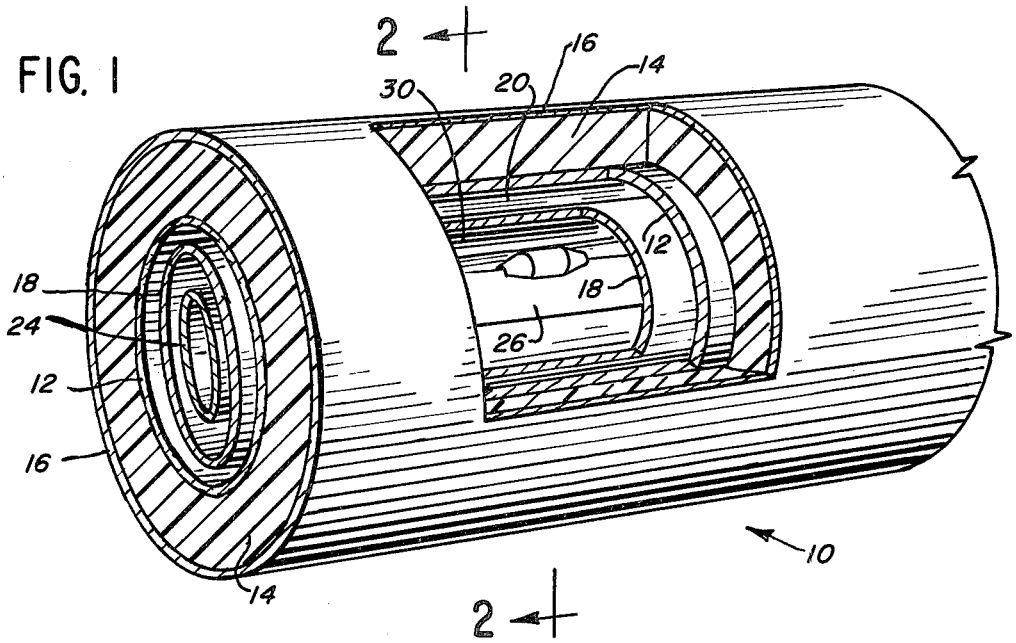
FIG. 1 is a partly cut-away isometric view of one cross-sectional portion between opposite ends of an exemplary scraped-surface heat exchanger as improved by this invention.

FIG. 1 shows one portion of an exemplary scraped-surface heat exchanger 10, generally of a type sold for many years by Chemetron Corporation under its trademark VOTATOR® and particularly as improved by this invention. In its conventional aspects, the heat exchanger 10 generally comprises a tube 12, which is surrounded by a layer of suitable insulation 14, and a sleeve 16, which surrounds the insulation 14. Another tube 18 is disposed concentrically within the tube 12 so as to form an annulus 20. A heating or cooling medium is passed through the annulus 20 between the tube 12 and the tube 18 via respective inlet and outlet conduits (not shown) which communicate with the annulus 20.

Figure 2:
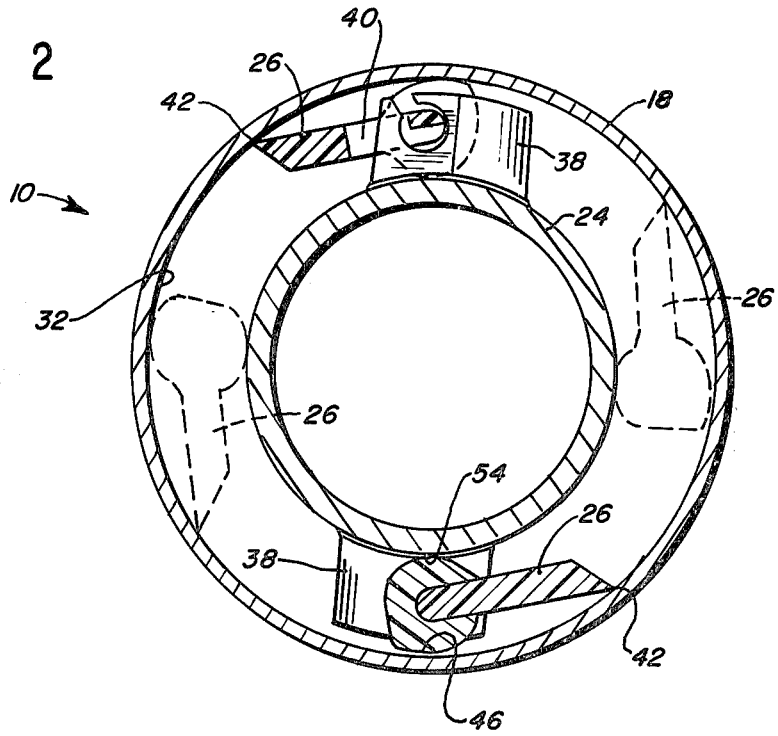
FIG. 2 is a diametrical cross-section taken generally along line 2—2 of FIG. 1 in the direction of the arrows, so as to show the inner elongated tube, rotary shaft, and scraper blades of the improved heat exchanger of FIG. 1. Various features including outer tubes and intermediate insulation are omitted from FIG. 2 for greater clarity.
Figure 3:
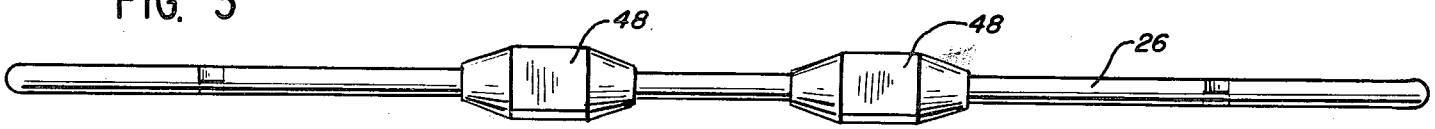
FIG. 3 is a view of one edge of one blade of FIG. 3.

A shaft 24, which is tubular as shown in FIG. 2, may be called a mutator in common parlance. The shaft or mutator 24, which carries a plurality of scraper blades 26 of particular construction according to this invention, is concentric with the tube 18 and rotatable, as described hereinbelow, about a common central axis of the tube 18 and the shaft 24, and so as to form an annulus 30 between the shaft 24 and the tube 18. Conventional means (not shown) are used to close and seal opposite ends of the annulus 20 and the annulus 30 and to allow the shaft 24 to be rotated by a conventional prime mover (not shown). In conventional manner, a product to be heated, sterlized, cooled, crystallized, or processed otherwise is passed through the annulus 30 via respective inlet and outlet conduits (not shown) which communicate with the annulus 30. The blades 26 are similar to conventional blades in two purposes, which are to plow, scrape, or remove accumulated product from the inner cylindrical wall 32 of the tube 18 and to mix the product within the annulus 30.

Various media including water, steam, brine, and ammonia, as well as fluids suitable for high temperatures and refrigerants suitable for direct expansion, may be passed through the annulus 20 either to heat or to cool the product as may be appropriate. The product to be processed may be a liquid, a slurry, or other product pumpable through the annulus 30.

Figure 4:
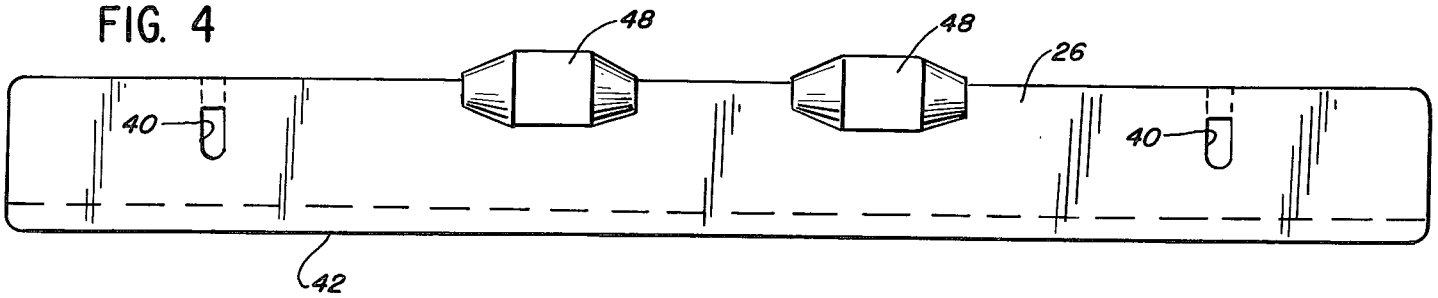
FIG. 4 is a view from the underside of the blade as shown in FIG. 3.

As shown in FIG. 2, the blades 26 are hinged to the shaft 24, for pivotal movement about an axis parallel to the axis about which the shaft 24 rotates, by a pair of conventional pins 38 extending radially from the shaft 24 and cooperating with elongated slots 40 to enable the blades 26 to be mounted to the shaft 24 and dismounted. Analogous uses of similar pins to mount scraper blades of other constructions are shown in FIGS. 4 through 6 of U.S. Pat. No. 3,848,289.

As also shown in FIG. 2, one edge 42 of each blade 26 leads a plane defined by the axis about which such blade 26 pivots and the axis about which the shaft 24 rotates—vertical plane in FIG. 2—to scrape the product being processed from the inner cylindrical wall 32 of the tube 18 as the shaft 24 rotates in a given rotational sense, which is counter-clockwise as shown in FIG. 2. Each leading and scraping edge 42 is sharpened to an angle of approximately 45°.

One material useful for the blades 26 is polysulfone, which is available commercially from Union Carbide Corporation as UDEL#P-1700-Natural-11-Polysulfone, but other materials known for scraper blades are expected to be suitable. As described below, the blades 26 have a novel and advantageous construction, which not only provides the only bearing surfaces required to center the shaft 24 and facilitate its rotation but also effectively addresses aforementioned problems in disassembly and reassembly and also allows the blades 26 advantageously to be biased against the wall 42 without separate springs.

According to this invention, each blade 26 bears on the wall 32 at respective outer bearing surfaces 46, which are formed as described hereinbelow, and which trail the plane mentioned above—vertical plane in FIG. 2—as the shaft 24 is rotated, as to hold its edge 42 in scraping relation to the wall 32 as the shaft 24 is rotated. Each blade 26 is thin and flat and may be molded in one piece, as conventional blades are made, except for respective roll-like portions 48 protruding from the blade 26 and comprising respective portions of the surface 46, whereby the blade 26 contacts the wall 32 only at the edge 42 and respective surfaces 46.

As shown in full lines in FIG. 2, two blades 26 of like construction are mounted in like manner to the shaft 24, in diametric opposition to each other. As suggested in phantom lines in FIG. 2, two blades 26 of like construction may be mounted in like manner to the shaft 24, in diametric opposition to each other with approximately 90° of angular separation between the blades 26 in full lines and the blades 26 in phantom lines. Preferably, the blades 26 are arranged in an overlapping and staggering relationship, as shown and described for different blades in U.S. Pat. No. 3,235,002.

Each blade 26 also has respective inner bearing surfaces 54, which also are formed on the roll-like portions 48, and which are adapted to bear on the shaft 24. Thus, radial movement of the shaft 24 toward the wall 32 is limited by the roll-like portions of the blades 26, and slight clearances at the pins 38 allow the shaft 24 to float within the wall 32. As shown, four blades 26 having approximately 90° of angular separation respectively therebetween provide the only bearing surfaces needed to center the shaft 24 therewithin and to facilitate the rotation of the shaft 24.

The blades 26 eliminate any need for "shaft skids" in disassembly and reassembly, as each blade 26 serves as a "skid" between the surfaces 46 and the surfaces 54. Frictional contact between the blades 26 and the wall 32 is characteristic of normal operation of the heat exchanger 10 and thus causes no difficulties in disassembly and reassembly.

Commercially available pre-polished stainless steel tubes may be used, particularly for the tube 18 and the shaft 24, which do not require further boring or honing operations because of this invention. Slight cambers, as commonly encountered with such commercially available tubes, may be accommodated easily. An elongated tube, as accordingly may be used for the shaft 24, may be sufficiently limber to accommodate a camber in the tube 18. Large ratios of overall length to inner diameter thus may be achieved at low costs as compared with the costs of conventional scraped-surface apparatus.

Frictional contact between the surfaces 46 of the blades 26 and the wall 32 advantageously tends to rotate the blades 26, counterclockwise as shown in FIG. 2, and thus to bias the leading or scraping edges 42 of the blades 26 against the wall 32. Separate springs and similar expedients are unnecessary.

I claim:

1. In a scraped-surface apparatus of a type comprising:

(a) a tube having an inner cylindrical wall;

(b) a shaft concentric with the wall and rotatable about a common central axis of the axis of the shaft and the wall, so as to define an elongated annual space to confine a product to be processed in the tube between the shaft and the wall; and (c) a plurality of scraper blasts of a material that does not score said wall, each blade being hinged to the shaft for pivotal movement about an axis substantially parallel to the axis of about which the shaft rotates, one edge of each blade leading a plane defined by said axes to scrape the product from the wall as the shaft rotates in a given rotation sense;

an improvement wherein said blades are spaced around said shaft in circumscribing relation thereto and each blade bears on the wall at a surface near said plane as the shaft is rotated, so as to center and support the shaft and facilitate its rotation, and so as to hold said edge in uniform scraping relation to the wall as the shaft thus rotates.

2. The improvement of claim 1 wherein the blades provide the only bearing surfaces centering and supporting the shaft and facilitating its rotation.

3. The improvement of claim 1 wherein the blade is thin and flat, except for a portion protruding from the blade and comprising said surface, whereby the blade contacts the wall only at said edge and at said surface.

4. The improvement of claim 3 wherein said portion protruding from the blade also comprises a surface which is adapted to bear on the shaft so as to limit radial movement of the shaft toward the wall.

5. The improvement of claim 1 wherein the blade is thin and flat, except for plural portions protruding from the blade and comprising respective portions of said surface, whereby the blade contacts the wall only at said edge and at respective portions of said surface.

6. The improvement of claim 5 wherein each portion protruding from the blade also comprises a surface which is adapted to bear on the shaft so as to limit radial movement of the shaft toward the wall.

7. The improvement of claim 5 wherein at least four blades are arranged in respective pairs around said shaft in diametric opposition to each other within each pair.

* * * * *